United States Patent [19]

Akkerman et al.

[11] 4,396,066

[45] Aug. 2, 1983

[54] METHOD AND APPARATUS FOR EFFECTING SEALED CONNECTION TO UPSTANDING IRREGULAR END OF TUBING POSITIONED IN A WELL

[75] Inventors: Neil H. Akkerman, Kingwood; Aubrey C. Mills, Houston, both of Tex.

[73] Assignee: Baker International Corporation, Orange, Calif.

[21] Appl. No.: 259,783

[22] Filed: May 1, 1981 (Under 37 CFR 1.47)

[51] Int. Cl.[3] ..... E21B 33/129

[52] U.S. Cl. ..... 166/387; 166/134; 285/145

[58] Field of Search ..... 166/387, 380, 134; 285/145, 147, 148

[56] References Cited

U.S. PATENT DOCUMENTS

| | | | |
|---|---|---|---|
| 2,589,506 | 3/1952 | Morrisett | 166/134 |
| 2,598,340 | 5/1952 | Baker et al. | 166/134 |
| 2,823,754 | 2/1958 | Ault | 166/134 |
| 2,929,453 | 3/1960 | Conrad | 166/134 |
| 3,394,762 | 7/1968 | Young | 166/134 |

*Primary Examiner*—Ernest R. Purser
*Assistant Examiner*—Thuy M. Bui
*Attorney, Agent, or Firm*—W. C. Norvell, Jr.

[57] ABSTRACT

An improved apparatus and method are provided for effecting a sealed connection to an upstanding end of a tubular member in a subterranean well where the upstanding end of the tubular member is of irregular configuration at one end. A connecting housing is lowered by a tubing string over the upstanding end of the tubular member and is provided internally with an annular elastomeric seal element and two pairs of cooperating slip elements respectively disposed above and below the annular seal. The actuation of the slip elements to engage the housing with the tubular member is such that a predetermined amount of compression force can be applied to the annular seal to insure that the seal will resist the normal fluid pressures encountered in the well operation, but forces in excess of such predetermined limit are not applied to the seal by the manipulative movements of the reconnected tubing string. The apparatus may include scrapers for scraping the upstanding end of the tubular member to remove particulates adhering thereto prior to effecting the engagement of the annular seal and the various slip elements therewith.

8 Claims, 6 Drawing Figures

METHOD AND APPARATUS FOR EFFECTING SEALED CONNECTION TO UPSTANDING IRREGULAR END OF TUBING POSITIONED IN A WELL

BACKGROUND OF THE INVENTION

1. Field of the Invention

The invention relates to a method and apparatus for effecting a sealed connection of a tubing string to a tubular member positioned down hole in a subterranean well which has had the top end portion thereof severed by either acid, explosion, or the like, hence presenting an irregular, unthreaded or partially threaded upstanding end surface.

2. Description of the Prior Art

It occasionally becomes necessary to effect the severance of a tubing string in a subterranean well at a down hole point in the well by either acid cutting, by an explosive method, or the like. These drastic methods of effecting the severing of the tubing string may be required if the packer or other tool is stuck in the well.

Utilization of acid or explosive cutting of the tubing string at a down hole position necessarily results in the tubing remaining down hole having an irregularly shaped, top end portion. Connectors for such down hole tubing, collaquially called a "pack-off over shot," have heretofore been provided comprising an annular elastomeric sealing element which is mounted within a housing and lowered on the tubing string to a position surrounding the top end of the tubular member. Slips are provided in the housing which are cam actuated to respectively expand and contract into engagement with the inner wall of the housing and the outer wall of the tubular member, and to concurrently impart an axial compressive force on the annular elastomeric material.

In such prior art connectors, the amount of axial force imposed upon the annular elastomeric seal is in no manner limited, and the greater the axial force that is applied through the connector, the greater will be the axial compression force on the seal. This inherently results either in undesirable extrusion of the elastomeric seal material, or an axial collapsing of a portion of the wall of the tubular member tubing engaged by the seal or the blowing out of the wall of the housing containing the seal.

There is, therefore, a need for a sealed connection for an irregular shaped upstanding end of down hole tubular member which will impose sufficient axial compression force on the annular seal to insure that the seal will maintain its integrity under any fluid pressures encountered in the operation of the particular well, yet limits the application of excessive compression forces to the seal by the subsequent manipulative movement of the tubing string.

SUMMARY OF THE INVENTION

The invention provides an improved apparatus, and method for operating such apparatus, for effecting a sealed connection to an upstanding end of a down hole tubular member. The connection and seal apparatus comprises a tubular housing mounting an annular elastomeric seal within an appropriate interior recess. Also mounted in such recess are two pairs of slip elements respectively disposed both above and below the annular elastomeric seal. Lowering of the housing over the upstanding end of the tubular member results in the annular elastomeric seal surrounding an end portion of the tubular member. The reversal of the movement of the connecting housing to raise the housing relative to the tubular member effects an immediate engagement of an upper slip element with the top end of the tubular member tubing while the lower slip elements have ratchet shaped internal teeth which do not bite into the tubing and hence move upwardly, imparting a compressive force to the annular elastomeric seal. The compressive force imposed on such a seal is backed up by a two piece force transmitting ring which is disposed between the top end of the elastomeric seal and the upper engaged slip element. An annular shear element secures the two piece force transmitting ring in assembly and, when a desired amount of axial compressive force has been imparted to the annular elastomeric seal, such shear element shears and the one portion of the force transmitting ring moves upwardly to force another upper slip element outwardly into biting engagement with the inner wall of the connecting housing. This slip element, as well as one of the lower slip elements, has external teeth that are shaped to prevent any further upward movement of the connecting housing with respect to the tubular member, and thus the compressive force in the annular elastomeric seal remains constant and trapped therein between the various slip elements. Moreover, the application of additional upward or downward force to the connecting housing by manipulation of the tubing string will not change the amount of compressive force exerted on the annular elastomeric seal.

In accordance with a modification of this invention, the interior surfaces of the annular elastomeric seal and the various slip elements are covered by a sleeve which is slidably mounted within the connecting housing but maintained in its protective position by one or more shear pins until a downwardly facing shoulder on such sleeve engages the top end of the tubular member. Such engagement effects the shearing of the shear pins and the movement of the protective sleeve upwardly as the connecting member is lowered into surrounding relationship with the upper end of the tubular member. Additionally, the bottom end of the connecting member may be provided with a plurality of radially contractible scrapping elements which snugly engage the external periphery of the tubular member and effect a scraping of such tubing to remove encrustation therefrom prior to the engagement of the slip elements and the annular seal with the top portions of the tubular member.

DESCRIPTION OF THE PREFERRED EMBODIMENTS

Figure 1:
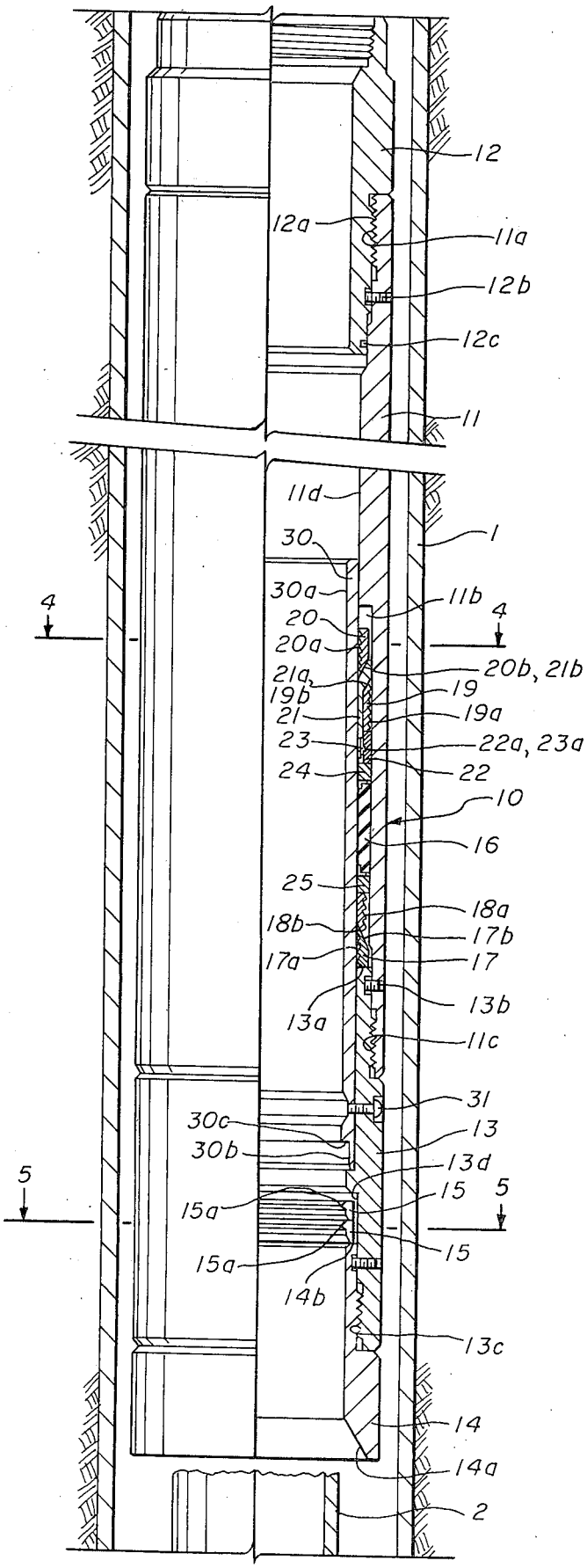
FIG. 1 is a schematic vertical sectional view of a sealable connector with the elements thereof in their positions prior to engagement with the upstanding irregular end of a piece of tubular member.

Referring to the drawings, the numeral 1 indicates the casing of an oil or gas well. Disposed within the lower portions of such casing is the upstanding irregular end 2 of a down hole tubular member which for whatever reason, had to be severed by either acid cutting, explosive techniques, or otherwise.

To reconnect the downhole tubing 2 to a new tubing string, a connecting apparatus 10 embodying this invention is provided. Connecting apparatus 10 includes a main housing 11 defined by an elongated cylindrical element which is threadably secured at its top end by threads 11*a* to a connecting sub 12 with threads 12*a* which in turn is provided at its top end with internal threads for connection to the bottom end of the new tubing string (not shown). A set screw 12*b* anchors this threaded connection and an O-ring seal 12*c* prevents fluid leakage therebetween.

At its lower end, the tubular housing 11 is provided with an internal, axially elongated recess 11*b* which terminates in an internally threaded portion 11*c*. This portion is threadably engaged with the upper end of an intermediate connecting sleeve 13. The top end 13*a* of sleeve 13 thus defines the bottom end of the housing recess 11*b*. One or more radially disposed set screws 13*b* are provided to effect the locking of this threaded connection.

Connecting sleeve 13 in turn is provided at its lower end with internal threads 13*c* which engage external threads provided on the upper end of a guide sleeve 14 which has a bottom outwardly flared conical surface 14*a* to effect the guiding of the sleeve 14 into surrounding relationship with the irregularly shaped end of the tubular member 2. Sleeve 13 is also provided at its lower end with a counter bore 13*d* and this counter bore, in cooperation with the top end 14*b* of the guide sleeve 14, provides a retention mounting for a plurality of resiliently expansible scraper elements 15 having internal scraping edges 15*a*. Each of the scraping elements 15 is fabricated from spring material and is of C-shaped configuration so that it tends to maintain its minimum diameter or closed position wherein the diameter of the scraping edges 15*a* is less than the exterior diameter of the tubular member 2, thus insuring a vigorous scraping action on the external surface of tubular member 2 as the connection housing 11 is lowered thereover.

Figure 2:
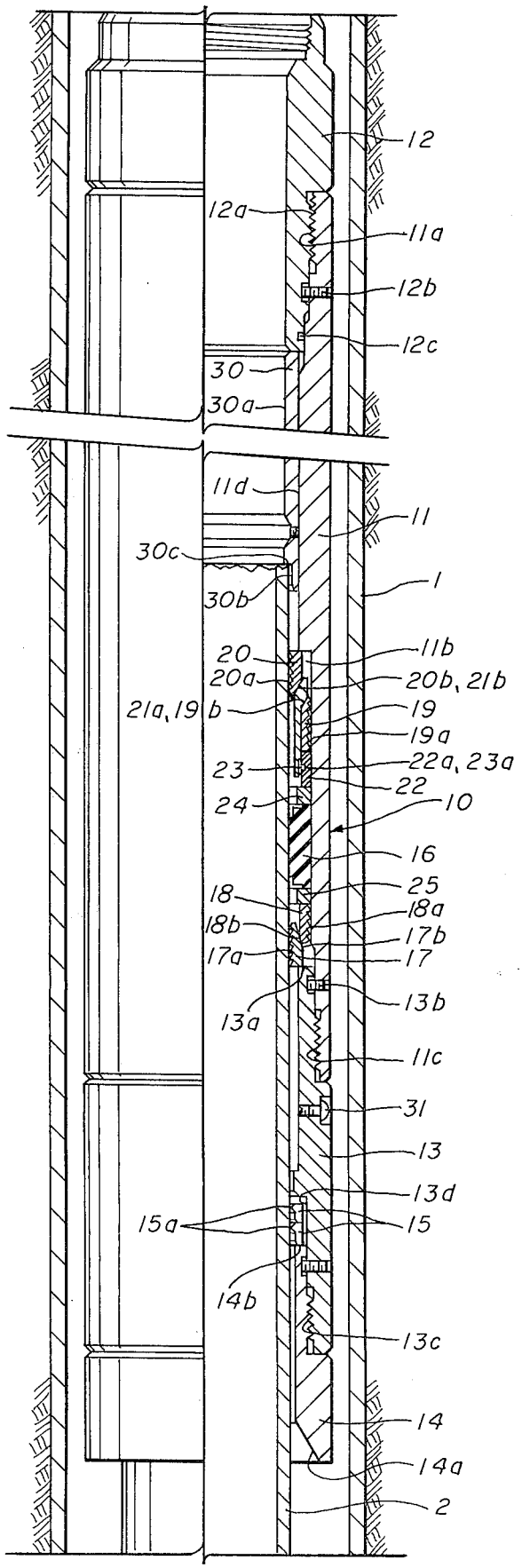
FIG. 2 is a view similar to FIG. 1 showing the elements of the connector in engaged and sealed position with the upstanding end of the tubular member.
Figure 3A:
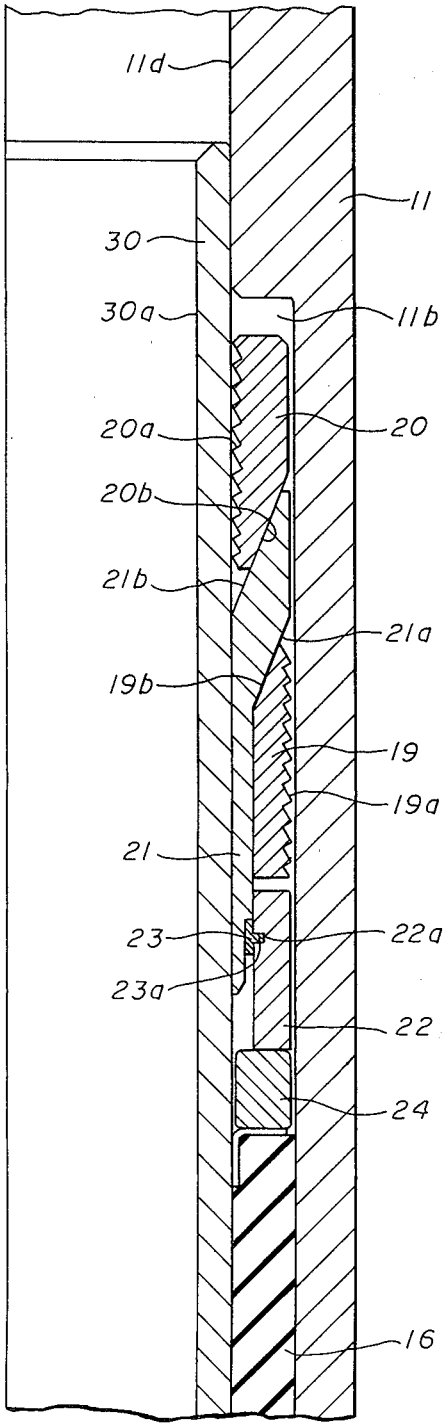
FIGS. 3A and 3B are enlarged scale views of the portion of FIG. 1 containing the slip elements and annular seal, FIG. 3B being a vertical continuation of FIG. 3A.
Figure 3B:
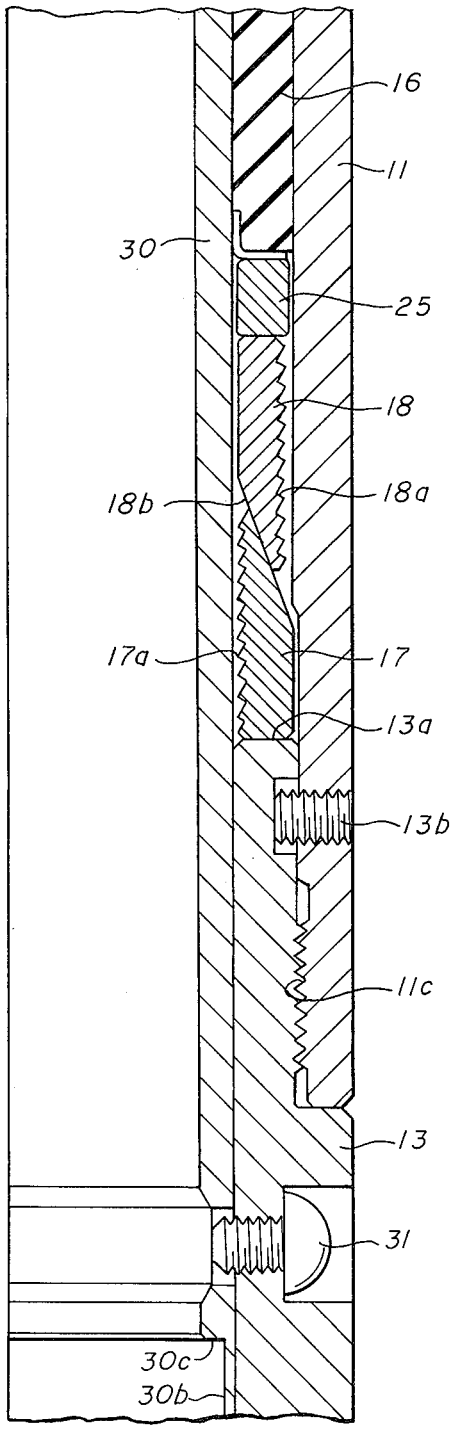
Figure 4:
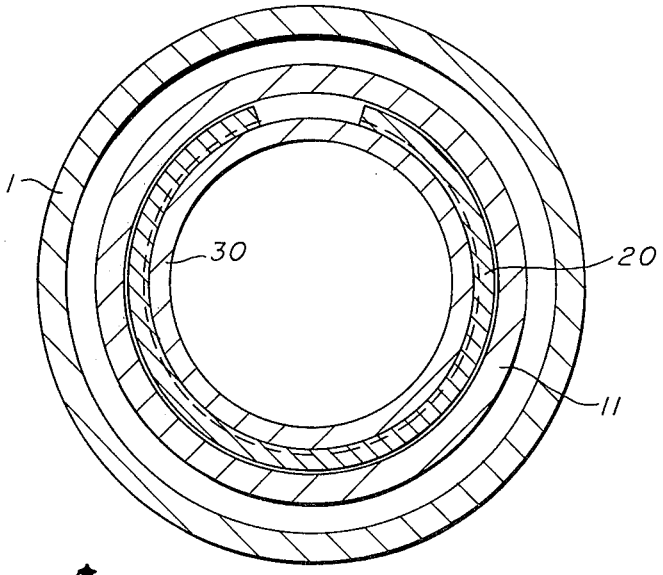
FIG. 4 is a cross-sectional view taken along section 4—4 in FIG. 1.
Figure 5:
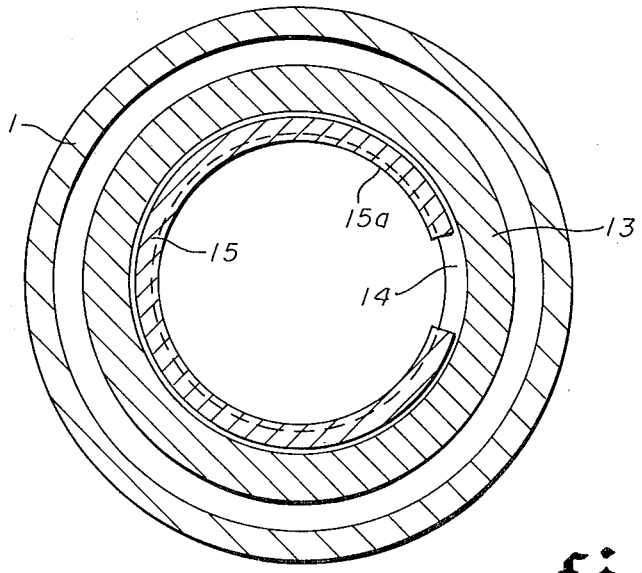
FIG. 5 is a cross-sectional view taken along section lines 5—5 in FIG. 1.

Within the axially elongated recess 11*b*, an annular elastomeric seal element 16 of conventional configuration is mounted and is disposed between a pair of lower slip elements 17 and 18 and a pair of upper slip elements 19 and 20. All of these slip elements are conventionally formed from spring material in a C-shaped configuration. The lowermost slip element 17 and the uppermost slip element 20 are radially contractible, while the intermediate elements 18 and 19 are radially expansible. The internal teeth 17*a* of the contractible lowermost slip element 17 are shaped so as to permit only relative upward movement of slip 17 with respect to the external surface of the tubular member 2 with which they will be eventually engaged, as illustrated in FIG. 2, through the application of an axially derived camming force. The internal teeth 20*a* of the uppermost slip element 20 are oppositely inclined so as to permit only relative downward movement of the connecting housing 11 with respect to the tubular member 2, and to engage such tubing and block relative upward movement with respect thereto.

The slip 18 is provided with external teeth 18*a* which are dimensioned to engage the inner walls of the housing recess 11*b* to prevent relative downward movement of the housing 11 with respect to the slip 18. Lastly, the slip 19 is provided with external teeth 19*a* which are proportioned to prevent relative upward movement of the housing 11 with respect to the slips. The slips 17 and 18 are additionally provided with cooperating conical surfaces 17*b* and 18*b* which, upon the application of an axial force to either of said slips, intensifies the biting engagement of the teeth 17*a* and 18*a* with the tubular member 2 and the wall of housing recess 11*b* respectively.

The upper slip elements 19 and 20 also have opposed conical faces 19*b* and 20*b* but these faces are not directly abuttable. Instead, they respectively abut the similarly shaped surfaces 21*a* and 21*b* of a thrust transmitting ring element 21 which is secured to a second thrust transmitting ring element 22 by an axially shearable ring element 23 which has a T-shaped cross-section. To permit the assemblage of ring element 23 between the thrust transmitting rings 21 and 22, it may be fabricated as a compressible C-shaped spring element which surrounds the lower extremities of thrust transmitting ring 21 and has a radially projecting annular stem portion 23*a* thereof inserted within an internal slot 22*a* provided in the second thrust transmitting ring 22. While so connected, the assemblage functions as a unitary, two piece thrust transmitting ring which transmits an upward axial force only to the uppermost slip 20.

Intermediate the bottom end of the thrust transmitting ring 22 and the top end of the annular elastomeric seal 16, a solid thrust transmitting ring 24 is provided. Similarly, between the lower end of the annular elastomeric seal 16 and the top end of the slip 18, a solid thrust transmitting ring 25 is provided. Thus, any axial upward displacements of the lower set of slip elements 17 and 18 with respect to the upper slip elements 19 and 20 will result in the imposition of a compressive force on the annular elastomeric seal element 16.

The apparatus thus far described is capable of effecting a mechanical sealed connection between the housing 11 and the upstanding end of the tubular member 2. It is well known, however, that as the housing 11 is lowered into the well, undesirable particulates may tend to accumulate on the internal surfaces of the slip elements and the elastomeric seal. Accordingly, in accordance with a preferred modification of this invention, an inner sleeve 30 is provided which is axially slidably mounted within the bore 11*d* of the main housing 11. The sleeve 30 is of sufficient length so that when positioned in a lower position by one or more radially disposed shear screws 31 it will completely overlie all of the slip elements and the elastomeric seal, thus protecting the internal surfaces of such elements from deposit of undesirable particulates. The number and strength of shear screws 31 determines the shearing force required.

The internal bore 30*a* of the inner sleeve 30 is of smaller diameter than the external diameter of the tubular member 2. A counterbore 30*b* is provided in the bottom end of the inner sleeve 30 having a diameter which will permit such bottom end portion to slide over the extreme top end portion of the tubular member 2. The downwardly facing shoulder 30*c* provided at the top end of counterbore 30*b* then abuts the top irregular surface of the tubular member 2. Upon such abutment, the further downward movement of the housing 11 would be prevented until sufficient downward force is applied by the operator to the housing 11 to effect the shearing of the shear screws 31.

Upon the shearing of such screws, the inner sleeve 30 moves upwardly within the bore 11*d* of the main housing 11 to the position illustrated in FIG. 2 wherein its bottom end is disposed entirely above the recess 11*b* of housing 11, hence above the upper slip element 20. During this upward movement, the counterbore 30*b* provides protection for the irregular end of the tubular member 2.

As previously mentioned, the ratchet shape of the teeth 17*a* and 20*a* of the contractible slips 17 and 20 permits such relative upward movement of the inner sleeve 30 because no axial force is being applied to any of the slip elements and the teeth 20*a* of slip 20 are so shaped as to permit the outer surface of inner sleeve 30 to freely slide thereby.

When, however, the inner sleeve 30 reaches its uppermost position wherein its top end abuts the end face of the top sub 12, further downward movement of the housing 11 is interrupted and this provides a signal to the operator to begin the setting operation.

As the housing 11 is lowered over the upstanding end of the tubular member 2, the radially expandable scraping elements 15*a* engage the exterior surface of the tubing 2 and scrape it free of any undesirable particulates adhering thereto, thus providing a smooth, clean surface for engagement by the slips 17 and 20 and the inner surface of the annular elastomeric seal 16.

The setting operation is accomplished through the simple expedient of raising the tubing string and thus raising the housing 11 relative to the now inserted end of the tubular member 2, as specifically illustrated in FIG. 2. The first effect of such raising movement is to cause the teeth 20*a* of the uppermost slip 20 to bite into the adjacent exterior wall of the tubular member 2 due to the resilient contraction of the slip 20. At the same time, the lowermost slip element 17 is being raised by the end surface 13*a* of the intermediate sleeve 13 and the interaction of conical surfaces 17*b* and 18*b* produces an upward displacement of these lower slip elements to apply a compressive force to the annular elastomeric seal through the ring 25 which is resisted by the upper torque transmitting ring 24, the united thrust transmitting rings 21 and 22 and the anchored upper slip 20.

Any desired degree of compressive force may thus be imposed upon the annular elastomeric seal 16, with the limits of such force being determined by the shearing of the axially shearable connecting ring 23 which is provided between the two thrust transmitting rings 21 and 22. Upon such shearing, the ring 22 is free to move upwardly and this force produces an engagement of the teeth 19*a* of the slip 19 with the inner wall of recess 11*b* and prevents further relative upward movement of the housing 11 with respect to the slip 19. Accordingly, the housing is effectively locked to the upper end of the tubular member 2 by the combined interaction of lower slip elements 17 and 18 and upper slip elements 19 and 20.

Further manipulation of the tubing string by the operator may then be accomplished without in any manner affecting the amount of compressive force applied to the annular elastomeric seal element 16. The upper slips 19 and 20 effectively prevent any relative upward movement of the housing 11 with respect to the tubular member 2 and the lower set of slips 17 and 18 effectively prevent any downward relative movement of the housing with respect to the tubular member 2.

It is accordingly apparent that the method and apparatus of this invention provides a convenient, economical method for effecting a sealed connection to a down hole tubular member having an irregular end. Most importantly, the tensile strength of the connection is substantially equal to the tensile strength of the tubing string and large tensile and/or compressive forces may be applied to the connection without in any manner disturbing the amount of compression trapped in the annular elastomeric seal. The selection of this amount of compression is predetermined by the selection of the shear strength of axially shearable ring element 23 which interconnects the two thrust transmitting rings 21 and 22.

Although the invention has been described in terms of specified embodiment which has been set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of forming a sealed connection with an upstanding end of a tubular member disposed in a subterranean well comprising the steps of:

(1) positioning an annular elastomeric seal on the interior of a tubular housing between lower expansible slip elements having teeth preventing downward movement of the housing relative to the tubular member when an axial upward force is applied to said lower slip elements and an upper contractible slip having teeth preventing relative upward movement of the upper slip when engaged with the tubular member;

(2) interconnecting the upper end of the annular elastomeric seal with the upper slip through shearably interconnected force transmitting elements;

(3) lowering the housing over the upstanding end of the tubular member with no axial forces on said upper and lower slips until both upper and lower slips surround the upstanding end of the tubular member;

(4) raising the housing relative to the tubular member to cause the upper slip to lockingly engage the tubular member and the lower slip elements to move axially upward to compress the annular elastomeric seal between the lower slip elements and the shearably interconnected force transmitting elements;

(5) increasing the axial force on said annular elastomeric seal by further upward movement of said housing until said shearable interconnection between said force transmitting elements is released; and (6) utilizing upward movement of the released one thrust transmitting element to force a third slip outwardly into engagement with the housing wall to lock the housing to the tubular member, whereby further manipulative movements of the housing does not change the force trapped in the compressed elastomeric seal.

2. The method of claim 1 wherein the upstanding end of the tubular member is exteriorly scraped concurrently with step 3.

3. An apparatus for establishing a sealed, force transmitting connection with an irregular upstanding end of a tubular member disposed in a subterranean well, comprising, in combination: a main tubular housing having an internal bore exceeding the diameter of the tubular member; means on one end of said main tubular housing for connection to the bottom end of a tubing string, said main tubular housing defining an axially elongated annular recess surrounding the upper portions of said tubular member when said main tubular housing is lowered into telescoping relationship therewith; an annular elastomeric seal element mounted in said annular recess; a lower set of annular slip elements disposed in said recess below said elastomeric seal; an upper set of annular slip elements disposed in said recess above said elastomeric seal; said annular elastomeric seal being compressed by relative axial movement of one set of slip elements toward the other set of slip elements; means on said slip elements for effecting a locking engagement between said main housing and said tubular member preventing relative downward movement of said housing only upon the occurrence of an upward force on said slip elements; one of said set of slip elements including a contractible slip having teeth engageable in locking relationship with said tubular member upon occurrence of upward relative movement of said housing with respect to said downhole tubing; one of said set of slip elements including an expansible slip having teeth engagable with the interior bore of said main housing upon the application of an axially upward force to one of said sets of slip elements, and a two piece thrust transmitting ring disposed between one said set of slip elements and the upper end of said annular elastomeric seal; axially shearable means interconnecting said pieces of said thrust transmitting ring, one of said pieces being in engagement between said contractible slip and the top portions of said annular elastomeric seal, the other piece of said two piece thrust transmitting ring being movable into engagement with said expansible slip only after the shearing of said axially shearable means, whereby the application of an upward force to said main tubular housing after it is telescoped into position surrounding the upstanding end of the tubular member produces an upward movement of said lower slip elements to effect the compression of said annular elastomeric seal against said contractible slip of one of said sets of slip elements until a predetermined degree of compressive force is trapped in said annular elastomeric seal, whereupon said shearable means shears and said expansible slip is moved by the other piece of said two piece thrust transmitting ring into locking engagement with the main housing, thereby locking said main housing to said tubular member for further manipulative movements without affecting the degree of compression trapped in said annular elastomeric seal.

4. The apparatus defined in claim 3 wherein each of said slip elements comprises a C-shaped element fabricated from spring metal.

5. The apparatus defined in claim 3 wherein an annular scraping tool is mounted on the lower end of said main tubular housing, said tool being resiliently contractible and having internal scraping edges adapted to engage and scrape the upstanding end of the tubular member as said housing is lowered thereover.

6. The apparatus defined in claim 3, 4 or 5, further comprising an inner sleeve slidably mounted within said main tubular housing for limited axial movement relative thereto between a bottom well insertion position wherein said sleeve overlies all of said slip elements and said annular elastomeric sleeve, and an upper position wherein said sleeve is disposed above the upper slip elements; axially shearable means for securing said inner sleeve in said bottom position as said main housing is inserted in the well, said inner sleeve having a downwardly facing shoulder at its lower end engageable with the upper end of the tubular member, thereby imparting an upward force on said inner sleeve sufficient to effect the shearing of said axially shearable means to displace said inner sleeve upwardly from its said bottom position to its said upper position with respect to said main housing as said housing is lowered around the upper end of said downhole tubing.

7. The apparatus defined in claim 3, 4 or 5, further comprising an inner sleeve slidably mounted within said main housing for limited axial movement relative thereto between a bottom well insertion position wherein said sleeve overlies all of said slip elements and said annular elastomeric sleeve, and an upper position wherein said inner sleeve is disposed above the upper slip elements, a plurality of radially disposed separable elements securing said inner sleeve in said bottom position as said main housing is inserted in the well, said separable elements being insertable from the exterior of said main housing, whereby the number of said separable elements may be selected, said inner sleeve having a downwardly facing shoulder at its lower end engageable with the upper end of the tubular member, thereby imparting an upward force on said inner sleeve sufficient to effect the separation of said selected number of separable elements and displace said inner sleeve upwardly from its said bottom position to its said upper position with respect to said main housing as said main housing is lowered around the upper end of the tubular member.

8. Apparatus for establishing a sealed, force transmitting connection between a first outer tubular and a second inner tubular member, comprising: an annular recess defined between the first and second tubular members when the first tubular member is in concentric relationship with the second tubular member; an annular elastomeric seal element mounted in said annular recess; a lower set of annular slip elements disposed in said recess below said elastomeric seal; an upper set of annular slip elements disposed in said recess above said elastomeric seal; said annular elastomeric seal being compressed by relative axial movement of a first of the sets of slip elements toward the other set of slip elements; each of said sets of slip elements including expansible and contractible slip having teeth engageable with the interior of the first tubular member and the exterior of the second tubular member upon relative movement therebetween; the second of said sets of slip elements further comprising a two piece thrust transmitting ring disposed between oppositely facing slip elements and between said slip elements and said annular elastomeric seal; axially shearable means interconnecting said pieces of said thrust transmitting ring so that the two piece thrust transmitting element is in engagement with one of the contractable slips, the second piece of the thrust transmitting ring being movable into engagement with the expansible slip only after shearing of said axially shearable means, whereby the application of an axial force to one of said tubular members in concentric relation to the other tubular member produces movement of the first set of slip members to effect compression of said annular elastomeric seal against the contractible slip of the other set of slips until a predetermined degree of compressive force is trapped in said annular elastomeric seal, whereupon said shearable means shears and said expansible slip is moved by the other piece of said two piece thrust transmitting ring into locking engagement with the outer tubular member, thereby locking the outer to the inner tubular member for further manipulative movement without affecting the degree of compression trapped in said annular elastomeric seal.

* * * * *